US005527016A

United States Patent [19]

Wilkerson, Jr.

[11] Patent Number: 5,527,016

[45] Date of Patent: Jun. 18, 1996

[54] HANDRAIL POSITIONING APPARATUS

[76] Inventor: Wilborn F. Wilkerson, Jr., 4247 Yaleton Ave., Covina, Calif. 91722

[21] Appl. No.: 233,459

[22] Filed: Apr. 26, 1994

[51] Int. Cl.[6] ..... E04H 17/22

[52] U.S. Cl. ..... 256/67; 256/1; 256/69; 256/DIG. 6; 248/544; 248/125.9; 52/64; 52/183; 52/188; 182/113; 269/43; 269/289 R; 269/904; 269/909

[58] Field of Search ..... 248/124, 544; 52/182, 183, 188, 64; 182/113; 269/19, 37, 43, 289 R, 904, 909; 256/67, 68, 69, DIG. 6, DIG. 5, 59, 1

[56] References Cited

U.S. PATENT DOCUMENTS

| | | | |
|---|---|---|---|
| 2,436,800 | 3/1948 | Fryzel et al. | 269/19 X |
| 2,909,381 | 10/1959 | Bates | 248/124 X |
| 3,379,414 | 4/1968 | Thurnauer | 256/68 |
| 3,480,257 | 11/1969 | Bourn et al. | 182/113 X |
| 3,511,477 | 5/1970 | Seery | 256/69 X |
| 3,756,568 | 9/1973 | Mocny et al. | 182/113 X |
| 3,788,608 | 1/1974 | Raymond et al. | 52/183 X |
| 3,863,899 | 2/1975 | Werner | 256/68 X |
| 4,669,577 | 6/1987 | Werner | 182/113 |
| 4,856,761 | 8/1989 | Berner | 256/59 |
| 4,960,137 | 10/1990 | Pott et al. | 269/43 X |
| 4,989,689 | 2/1991 | Berlin | 256/DIG. 6 X |
| 5,263,550 | 11/1993 | Jines et al. | 182/113 |
| 5,288,058 | 2/1994 | Russell | 256/DIG. 6 X |

FOREIGN PATENT DOCUMENTS

| | | | |
|---|---|---|---|
| 9316260 | 8/1993 | WIPO | 256/DIG. 5 |

*Primary Examiner*—Dave W. Arola
*Assistant Examiner*—Christopher J. Novasad
*Attorney, Agent, or Firm*—Boniard I. Brown

[57] ABSTRACT

A handrail positioning apparatus for accurately positioning a handrail during the process of installing the handrail in an inclined position on a building wall above an inclined stairway. The apparatus may include two vertically adjustable stanchions positionable at the upper and lower ends of the stairway. Miniature platforms are tiltably mounted on the upper end portions of the stanchions to underlie end areas of a handrail. C-clamps may be used to clamp the handrail to the platforms. The platforms are so tiltable that the platforms can seat flatwise against the handrail, whatever the slope or inclination of the rail, and the stanchions are vertically adjustable to control the rail slope and rail height.

2 Claims, 1 Drawing Sheet

HANDRAIL POSITIONING APPARATUS

BACKGROUND AND SUMMARY OF THE INVENTION

The present invention relates to apparatus for use in the process of installing a handrail on a wall extending along a stairway. The apparatus temporarily holds the handrail in a position extending parallel to the direction of the treads of the stairway.

Typically, a stairway between floors of a building will incline upwardly along a vertical wall, and persons ascending or descending the stairway move parallel to the associated vertical wall. Quite often, a handrail is mounted on the wall to assist the person in moving up or down the stairway.

The handrail is generally positioned an appropriate distance above the stairway treads, and parallel to the nosing line of the stairway, which line is an imaginary diagonal line through the front edges of the stairway. The angulation or slope of the nosing line is related to the stairway length or flight) and its horizontal displacement (or run). Stairways have different lengths and slopes; the associated handrails have correspondingly different slopes or angulations.

Installation of handrails is often carried out without precise measurements of the handrail mounting locations. Errors in handrail positioning can readily occur. In one known installation method, two or more upright wooden boards are nailed to the steps of a stairway at spaced points along the stairway length. The boards are formed to desired lengths so that the upper ends of the upright boards establish locations for the handrail mounting brackets. Notches may be formed in the upper ends of the boards to support the handrail while the mounting brackets are being secured.

The present invention provides an apparatus for more precisely positioning the handrail relative to a stairway and its treads. The handrail positioning apparatus is so adapted that the handrail has the required slope (i.e., parallel to the stairway nosing line), and also a selected height above the stairway tread. Typically, the handrail height will vary from about thirty inches to about thirty-four inches, depending on individual preference. The handrail positioning apparatus of the present invention is vertically adjustable to provide a range of different handrail heights, e.g., from about thirty inches to about thirty-four inches.

In a preferred form of the invention, the apparatus comprises two upright stanchions adapted to be individually anchored to tread areas of a stairway at spaced points along the stairway length. Typically, one stanchion will be attached to a tread near the lower end of the stairway, and the other stanchion will be secured to a tread near the upper end of the stairway. Each stanchion extends vertically upwardly from the stairway tread. Each carries a tiltable platform near its tipper end. Conventional C-clamps are typically used to clamp a handrail to the spaced platforms so that the handrail is supported in an inclined position while the handrail mounting brackets are secured to the vertical building wall adjacent to the stairway. Each platform being tiltable, the platform surface conforms to the undersurface of the handrail so that the handrail may have any desired slope, while the C-clamps securely bold the handrail against the platform irrespective of handrail slope.

Preferably, each stanchion includes a screw jack for raising or lowering the platform at the upper end of the stanchion. Scale markings on the screw jack indicate the height of the platform above the associated stairway tread. The installer of the handrail can thus achieve a desired handrail height merely by looking at the scale markings and adjusting the jack structure upwardly or downwardly.

The apparatus is designed for ease and convenience of use by persons having no special skill in trigonometry or mathematics.

DESCRIPTION OF A PREFERRED EMBODIMENT OF THE INVENTION

Figure 1:
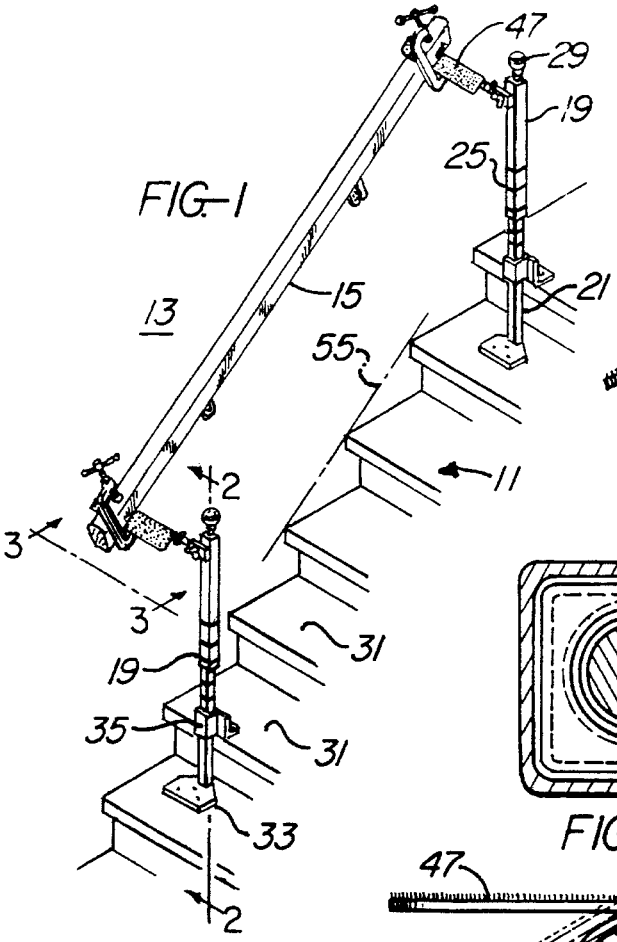
FIG. 1 is a perspective view of an apparatus according to the present invention in association with a handrail.

Referring to the drawings, FIG. 1 shows a conventional stairway 11 extending upwardly near a wall 13, and a handrail 15 to be positioned relative to the stairway.

Figure 3:
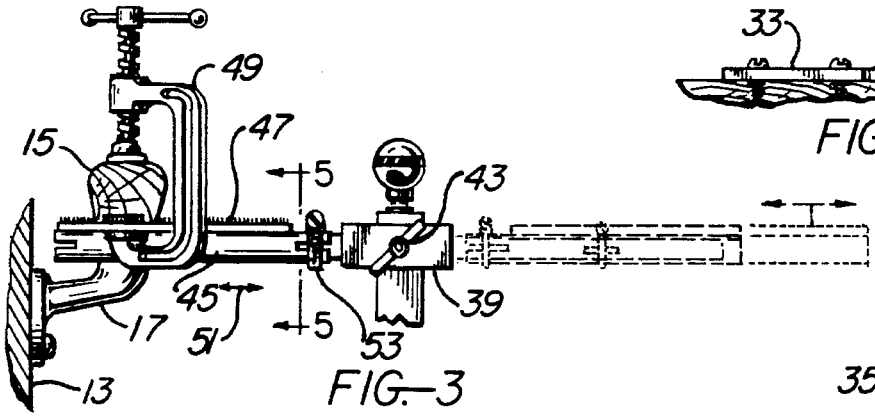
FIG. 3 is an enlarged fragmentary view taken on line 3—3 in FIG. 1.

Although the handrail may typically be positioned and installed without being attached to a wall, as indicated in FIG. 1. It may also be secured to a wall by brackets 17 secured by screws to the wall, as indicated in FIG. 3. In such instances, the handrail is positioned, by the apparatus of the present invention, in selected location while the mounting brackets are being attached to a wall, the mounting brackets being ordinarily attached to the handrail prior to securing of the brackets to the wall.

The handrail positioning apparatus comprises two upright stanchions 19 secured to treads of the stairway at spaced points along the stairway length. Ordinarily one stanchion is located near the upper end of the stairway, and the other stanchion is located near the lower end of the stairway. The object is to provide two widely spaced support points for the handrail, thus to better achieve stable handrail positioning.

Figure 2:
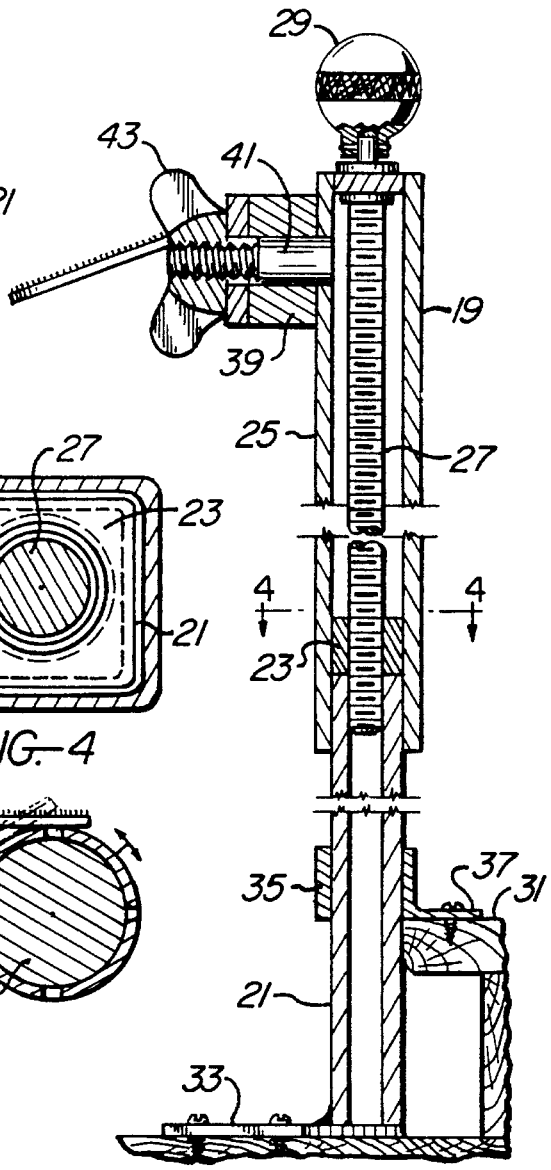
FIG. 2 is an enlarged sectional view taken on line 2—2 in FIG. 1.
Figure 4:
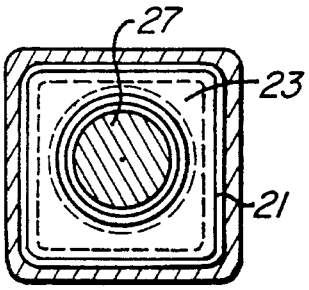
FIG. 4 is a sectional view taken on line 4—4 in FIG. 2.

As shown in FIG. 2, the stanchion includes a screw jack comprising a lower steel tube 21 having a nut 23 at its upper end, and an upper steel sleeve 25 telescoped onto tube 21 so that the sleeve can move up or down on the tube. The tube and sleeve have mating square cross-sectional configurations, whereby the sleeve is prevented from rotating.

A rotary screw 27 is rotatably journaled in a plate at the upper end of sleeve 25. An actuating knob 29, attached to the upper end of the screw, enables a person installing the handrail to rotate the screw, thus to raise or lower sleeve 25 on tube 21. Nut 23 may be affixed to the upper end of tube 21 or floatably seated on the tube upper end. In either case, the nut is fixed on the tube upper end.

Stanchion 19 is anchored to a stairway tread 31 by means of a footplate 33 and a collar 35. Threaded fasteners extend through the footplate into one tread. Additional fasteners extend through an ear 37 extending from collar 35 to secure the stanchion to the stairway.

Collar 35 is slidable on tube 21 to adapt the stanchion to different stairway riser heights. Typically, the vertical dimension of a stairway riser may vary from about 7½" to about 8½". Collar 35 being slidable on tube 21, the stanchion anchoring mechanism is adjustable to varying riser dimensions.

An arm structure 39 extends laterally toward wall 13 from the upper end of each stanchion sleeve 25. The portion of arm structure 39 engaged with sleeve 25 has a flat surface for seating flatwise against the sleeve outer face. A stud 41 extends from the sleeve through a hole in arm structure 39, and a wing nut 43 is threaded onto the stud to secure releasably to the arm structure to sleeve 25.

Figure 5:
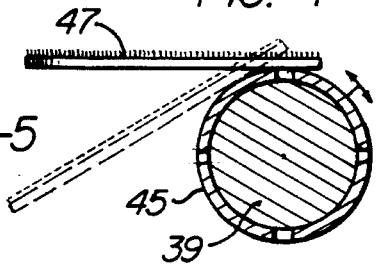
FIG. 5 is an enlarged sectional view taken on line 5—5 in FIG. 3.

The left end portion of arm structure 39, as viewed in FIG. 3, is of circular cross-section to provide a rotary mount for a cylindrical sleeve 45. A flat panel 47 is welded or otherwise secured to the outer surface of sleeve 45 to form a platform engageable with the flat undersurface of handrail 15. As indicated in FIG. 5, sleeve 45 is rotatable on the circular portion of arm structure 39 to vary the inclination or tilt of panel 47. By thus changing the panel inclination, the panel can seat flatwise against the handrail undersurface irrespective of the handrail slope. The handrail is detachably connected to each panel 47 by a conventional C-clamp 49.

Cylindrical sleeve 45 is rotatable on arm structure 39, and is horizontally slidable on the arm structure. Arrows 51 (FIG. 3) indicate the horizontal slidable motion of the sleeve toward or away from building wall 13. Such horizontal adjustment of sleeve 45 may be used to ensure a firm positioning of bracket 17 against wall 13 without loosening the C-clamp 49.

A conventional steel hose clamp 53 may be utilized to clamp sleeve 45 on the circular section of arm 39. Slits may be defined in the right end area of the sleeve to increase the deflectability of the sleeve.

Handrail 15 is preferably mounted to be essentially parallel to an imaginary nosing line extending across the edges of the stairway treads. In FIG. 1 such an imaginary nosing line is indicated at 55. The slope of the nosing line may vary as among stairways. It is affected by tread width and riser dimensions. The tread width usually varies between nine and ten inches. The riser dimension usually is in the range of 7½" to 8½".

The stanchions are adjusted so that each has the same height, i.e., each platform 47 has its upper edge the same distance above the associated footplate 33. The handrail will thus automatically be parallel to the imaginary nosing line 55.

In order for a workman to be informed of the stanchion height, the tube 21 will preferably have scale markings thereon referenced to the lower end edge of sleeve 25. Thus, inch markings on the tube may be observed at the lower end of sleeve 25 to ascertain the effective height of the stanchion.

The handrail height above the stairway treads may vary according to preference or particular building usage. Normally, the handrail will be in the range of thirty to thirty-four inches above the nosing line. The scale markings on tube 21 may be used to provide a desired handrail height. The invention thus enables a workman to achieve a selected handrail slope and a selected handrail height.

Figure 6:
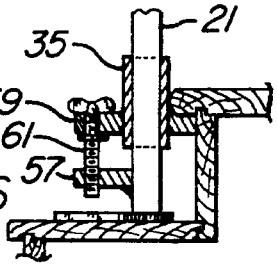
FIG. 6 is a fragmentary view taken in the direction of FIG. 2, showing alternate means for anchoring a stanchion to a tread of a stairway.

FIG. 6 shows an alternate mechanism for anchoring a stanchion to a stairway tread without utilizing screws or similar fasteners. In FIG. 6, a nut 57 extends forwardly from tube 21 and a plate 59 is welded to slidable collar 35 so that the rear edge of the plate can underlie the edge area of the upper stairway tread. A vertical screw 61 is rotatably journaled in plate 59 with its threaded shank area extending downwardly in mesh with nut 57. By turning screw 61, move plate 59 is moved upwardly to forcibly engage the lip of the upper tread, thereby anchoring the stanchion to the stairway.

FIG. 2 illustrates a preferred method of anchoring a stanchion to a stairway. FIG. 6 illustrates an alternative anchoring mechanism.

Arm structure 39 is adapted to extend in either of two directions from stanchion 19. FIG. 3 shows in full lines the arm structure extending leftwardly, and the broken lines show the arm structure extending rightwardly. To switch from one condition to the other it is necessary that the arm structure be removed from the stanchion, and that sleeve 45 be turned end-for-end on the shaft portion of structure 39. The purpose of this repositioning of the arm structure is to enable the use of the apparatus with building walls extending along the left edge of the stairway or along the right edge of the stairway.

Thus there has been shown and described a novel handrail positioning apparatus which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A handrail positioning apparatus for use in the process of installing a handrail above a stairway, comprising:

two jack structures, each having a stationary lower end portion and a vertically-adjustable upper end portion, means for anchoring the jack structure lower end portion to a tread of the stairway, each said anchoring means comprising a collar slidable vertically on the lower end portion of the associated jack structure, and an ear extending from said collar for positioning against a stairway tread, a platform rotatably carried by each arm structure for rotation about a horizontal axis extending transversely of the jack structure, whereby each said platform may be tilted to provide a range of different inclinations, and means for clamping each platform to a handrail so that the handrail is stationary while being affixed to a wall extending along the stairway, said jack structure being anchorable to widely spaced stairway treads, whereby the handrail is supported at widely spaced points along its length.

2. The handrail positioning apparatus of claim 1, wherein:

each said ear has a hole therein for extension therethrough of a fastener into the stairway tread to anchor the ear to the tread.

* * * * *